US005877464A

United States Patent [19]

Moldovan

[11] Patent Number: 5,877,464

[45] Date of Patent: Mar. 2, 1999

[54] ELECTRIC CURRENT SWITCHING APPARATUS WITH DUAL MAGNET ARC SPINNING EXTINGUISHER

[75] Inventor: Peter K. Moldovan, Cascade, Wis.

[73] Assignee: Eaton Corporation, Cleveland, Ohio

[21] Appl. No.: 49,509

[22] Filed: Mar. 27, 1998

[51] Int. Cl.[6] ..... H01H 33/18; H01H 9/44

[52] U.S. Cl. ..... 218/29; 218/38; 335/201

[58] Field of Search ..... 335/132, 16, 6, 335/201; 218/29, 34, 35, 36, 37, 38, 39, 40, 46, 148, 149, 150, 151, 155, 156

[56] References Cited

U.S. PATENT DOCUMENTS

| | | | |
|---|---|---|---|
| 2,051,478 | 8/1936 | Hampton et al. . | |
| 2,596,865 | 5/1952 | Peter . | |
| 3,629,533 | 12/1971 | Kuznestsov et al. | 218/149 |
| 4,056,798 | 11/1977 | Malick | 335/6 |
| 4,079,219 | 3/1978 | Weston . | |
| 4,376,271 | 3/1983 | Gallatin et al. | 335/159 |
| 4,539,451 | 9/1985 | Mori et al. . | |
| 4,568,805 | 2/1986 | Wycklendt . | |
| 5,004,874 | 4/1991 | Theisen et al. . | |
| 5,138,122 | 8/1992 | Moldovan et al. | 218/149 |
| 5,416,455 | 5/1995 | Moldovan et al. . | |

*Primary Examiner*—Lincoln Donovan
*Attorney, Agent, or Firm*—Quarles & Brady

[57] ABSTRACT

An electric arc extinguishing mechanism for an electric current switching apparatus employs a plurality of splitter plates in a conventional arc chute arrangement. Each splitter plate has a pair of permanent magnet structures that produce a magnetic field which interacts with the arc causing the arc to move continuously about the surface of the splitter plate until the arc is extinguished. Such movement prevents the arc energy from being concentrated in one spot which could melt the splitter plate.

18 Claims, 4 Drawing Sheets

ELECTRIC CURRENT SWITCHING APPARATUS WITH DUAL MAGNET ARC SPINNING EXTINGUISHER

BACKGROUND OF THE INVENTION

This invention relates to apparatus for switching electric current, such as direct current (DC) electricity; and more particularly to such apparatus which has a mechanism for extinguishing arcs formed between switch contacts during separation.

DC electricity is used in a variety of applications such as battery powered systems, drives for motors and DC accessory circuits, in which contactors are used to make and break load current. Weight, reliability and high DC voltage switching and interrupting capability are important considerations in developing the contactor. Furthermore, in many applications relatively large direct currents must be switched which produce arcs when the contacts of the contactor separate, thereby requiring a mechanism for extinguishing the arcs.

Previous DC contactors and switches incorporated one or more arc extinguishing chambers, often referred to as "arc chutes" such as described in U.S. Pat. No. 5,416,455, to extinguish arcs that formed between the switch contacts. Arc extinguishing chambers may comprise a series of spaced apart electrically conductive splitter plates. In DC switching devices, permanent magnets on the sides of the series of splitter plates establish a magnetic field across the arc extinguishing chamber which directs arcs into the splitter plate arrangement. The arc then propagates from one splitter plate to another in the series and eventually the arc spans a number of gaps between the splitter plates whereby sufficient arc voltage is built up that the arc is extinguished.

The arc in DC switching devices can become stabilized in one spot on a given splitter plate. This concentration of energy at one spot erodes the metal plate, particularly when the arc duration is relatively long as occurs with inductive loads.

SUMMARY OF THE INVENTION

A general object of the present invention is to provide a current switching apparatus incorporating a mechanism that extinguishes arcs which form when switch contacts separate.

Another object is to reduce arc induced erosion of components of the extinguishing mechanism.

A further object of the present invention is to provide such erosion reduction by causing movement of the arc across surfaces of splitter plates within the arc extinguishing mechanism.

These objectives are satisfied by an arc extinguishing mechanism that includes a plurality of splitter plates, each of which comprises a casing containing a permanent magnet assembly. The casing is formed of a non-ferrous, electrically conductive material and has a cavity bounded by a pair of walls that create two exterior surfaces. The permanent magnet assembly is located between the pair of walls and includes a first magnet structure with like magnetic poles adjacent to each wall. A second magnet structure within the assembly has opposite magnetic poles adjacent to each wall. The magnet assembly produces a magnetic field around the casing which causes an arc created within the electric current switching apparatus to be drawn onto the exterior surfaces of the casing and then continuously move about that surface until the arc extinguishes.

Such movement prevents the arc energy from being concentrated in one spot which can melt the splitter plate.

DETAILED DESCRIPTION OF THE INVENTION

Figure 1:
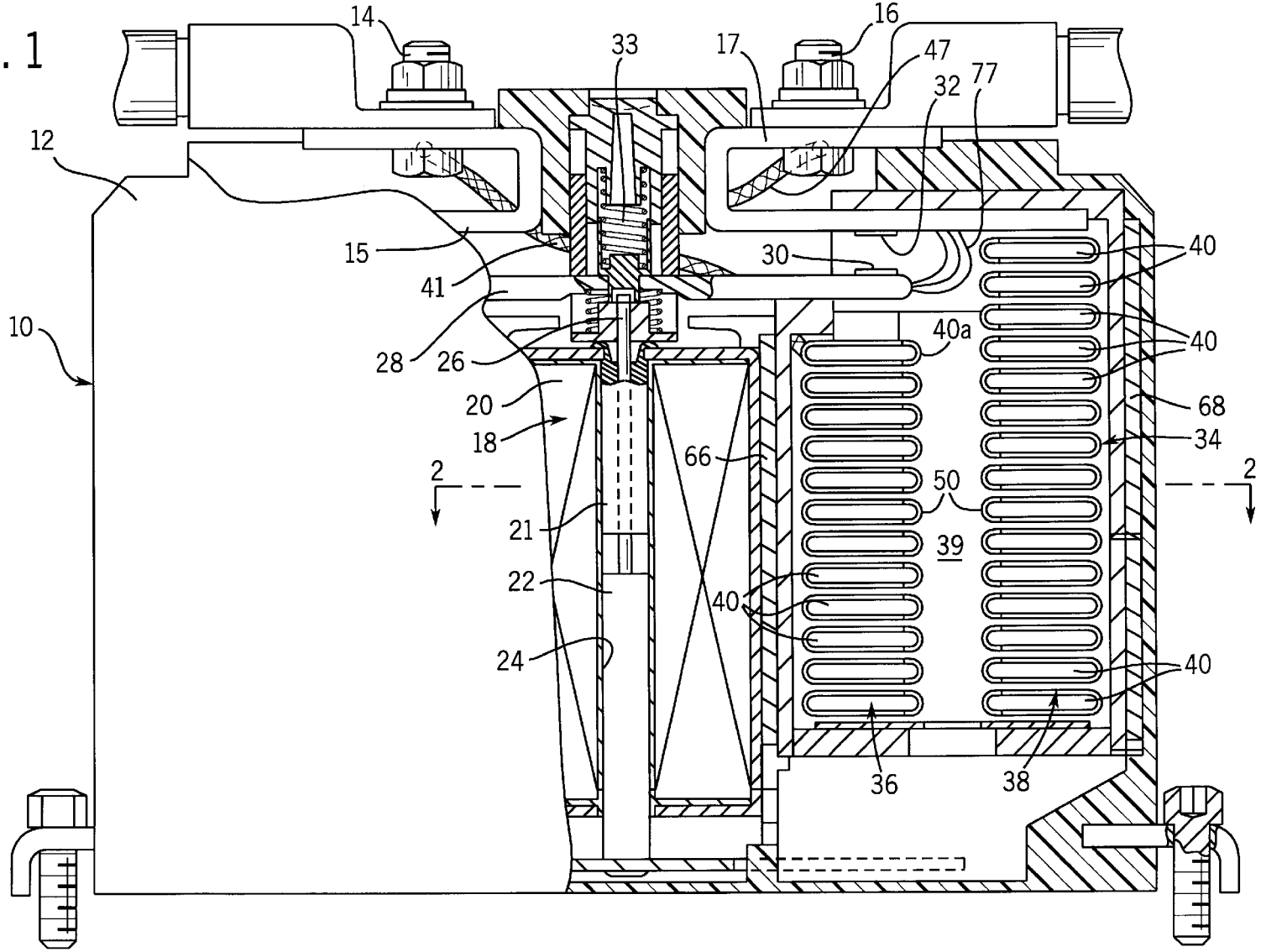
FIG. 1 is a cut away view of a DC contactor which incorporates an arc extinguishing chamber according to the present invention.

With reference to FIG. 1, a sealed electromagnetic single pole contactor 10 has a plastic housing 12 with first and second power terminals 14 and 16. The first power terminal 14 is connected to a first stationary contact 15 attached to the housing and the second power terminal 16 is connected to a second stationary contact 17.

An electromagnetic solenoid 18 nests in recesses in the interior surfaces of the housing 12. The solenoid 18 has an annular coil 20, a core 21 and an armature 22 located within the central opening 24. The armature 22 includes a shaft 26 that passes through the core 21 and connects to a moveable contact arm 28, which in the closed state of the contactor bridges the stationary contacts 15 and 17 completing an electrical path between the power terminals 14 and 16. Each end of the moveable contact arm 28 has a contact pad 30 which in the closed state abuts a mating contact pad 32 on the stationary contact 15 or 17 associated with that end of the moveable contact arm. A spring assembly 33 biases the moveable contact arm 28 and the armature 22 so that the contactor 10 is in a normally open position when the solenoid coil 20 is de-energized, as illustrated in FIG. 1.

Each end of the moveable contact arm 28 extends into a separate arc extinguishing chamber, or arc chute. The two arc extinguishing chambers are mirror images of each other with one chamber 34 visible in FIG. 1. Arc extinguishing chamber 34 is formed by two stacks 36 and 38 of spaced apart splitter plates 40 with a region 39 between the stacks. Note that the top splitter plate in the inner stack 36 is connected by a wire braid to the other power terminal than the one that the stack is beneath. For example, the top splitter plate 40*a* in the inner stack 36 beneath the second power terminal 16 is connected by a wire braid 41 to the first power terminal 14. Another wire braid 47 connects a splitter plate of the arc extinguishing chamber beneath the first power terminal 14 to the second power terminal 16.

Figure 3:
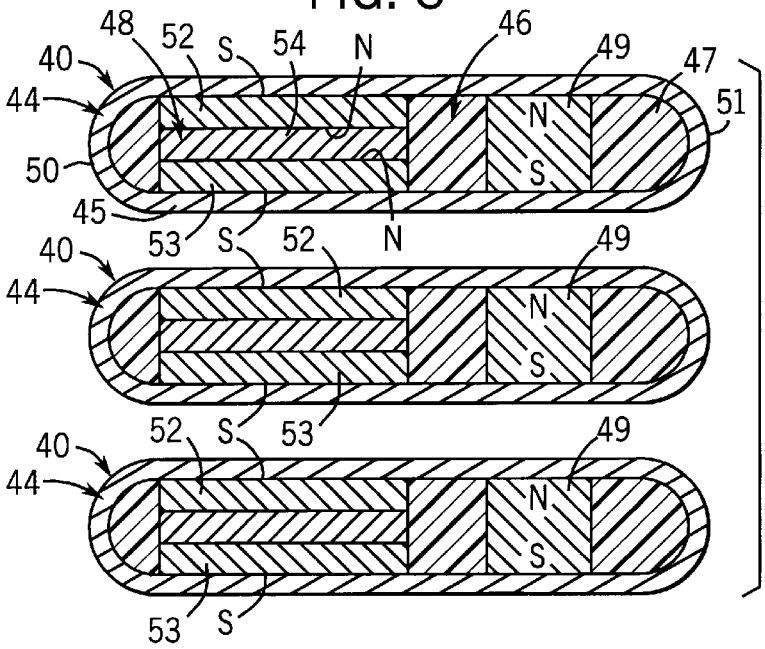
FIG. 3 is a side elevational view of several splitter plates in the arc extinguishing chamber.
Figure 4B:
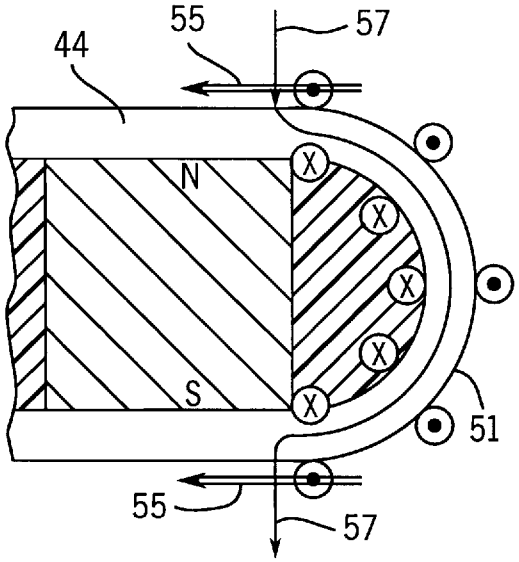
FIGS. 4A and 4B are enlarged cross sectional views of opposite sides of one splitter plate.
Figure 4A:
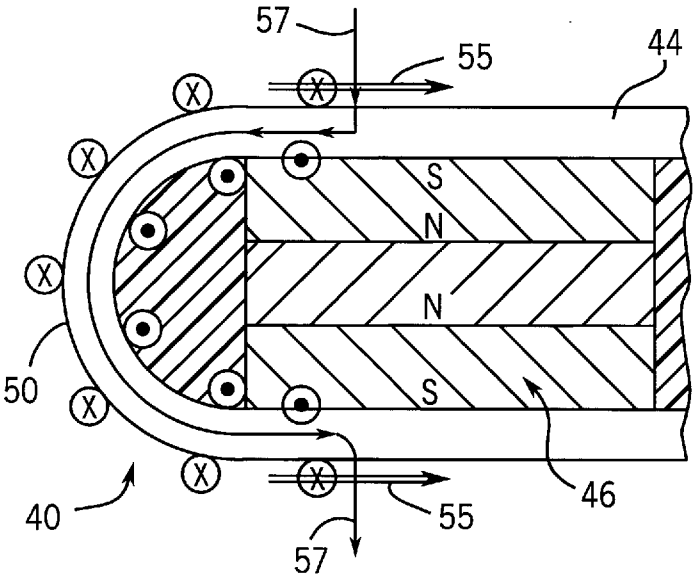

Referring to FIG. 3, each splitter plate 40 has an outer oblong tubular shaped casing 44 with a pair of identical planar legs 43 and 45 connected at inner and outer sides by curved edges 50 and 51. Curved edge 50 of each splitter plate 40 faces the center region 39 of the arc extinguishing chamber 34 as seen in FIG. 1. The splitter plate casing 44 is formed of an electrically conductive, non-magnetic material, such as copper. The splitter plate casing 44 is closed on the inner and outer sides to protect the magnet structure 46 from being damaged by the arc. In addition, both closed sides 50 and 51 provide a current "turn back" resulting in a Lorentz force 55 on the arc 57 where the arc touches the casing 44 as shown in FIGS. 4A and 4B. That Lorentz force 55 results from the self field of the arc current passing through the casing 44. When the arc is at the inner side 50 of the splitter plate 40, this force pulls the arc toward the center of the splitter plates. When the arc has traveled beyond the electrical center of the splitter plate 40, this Lorentz force 55 prevents the arc from continuing to travel outward and running off the splitter plate 40.

As seen in FIGS. 1 and 3, a magnet structure 46 is located within the opening of the tubular shaped casing 44. The magnet structure 46 comprises a magnet holder 47 which retains a laminated arc spin magnet assembly 48 and an arc spin magnet 49. The magnet holder 47 is fabricated of a non-magnetic material, such as a plastic or copper and has two cylindrical apertures there through for receiving the two cylindrical magnets 48 and 49.

The laminated magnet assembly 48 comprises a first magnet disk 52 abutting one of the legs 43 of the casing 44. Another magnet disk 53 abuts the other leg 45 of the casing with an iron disk 54 positioned between the two magnet disks. The two magnet disks 52 and 53 are oriented so that their south magnetic poles (S) are adjacent to the respective casing legs 43 and 45 and their respective north magnetic poles (N) abut the iron disk 54. Each component 52–54 of the laminated magnet assembly 48 has a thickness equal to approximately one-third the distance between the two casing legs 43 and 45. The lamination of the magnet disks in assembly 48 enables the same polarity to appear at both major surfaces of the same splitter plate which aids in moving an electric arc onto the splitter plate, as will be described.

The arc spin magnets 49 within the splitter plates 40 have their magnetic poles oriented in the same direction. In the embodiment illustrated in FIG. 3 for example, the north magnetic poles of these magnets 49 all face upward. Thus the north pole of the arc spin magnet 49 of one splitter plate faces the south pole of the arc spin magnet 49 in the adjacent splitter plate 40.

Figure 2:
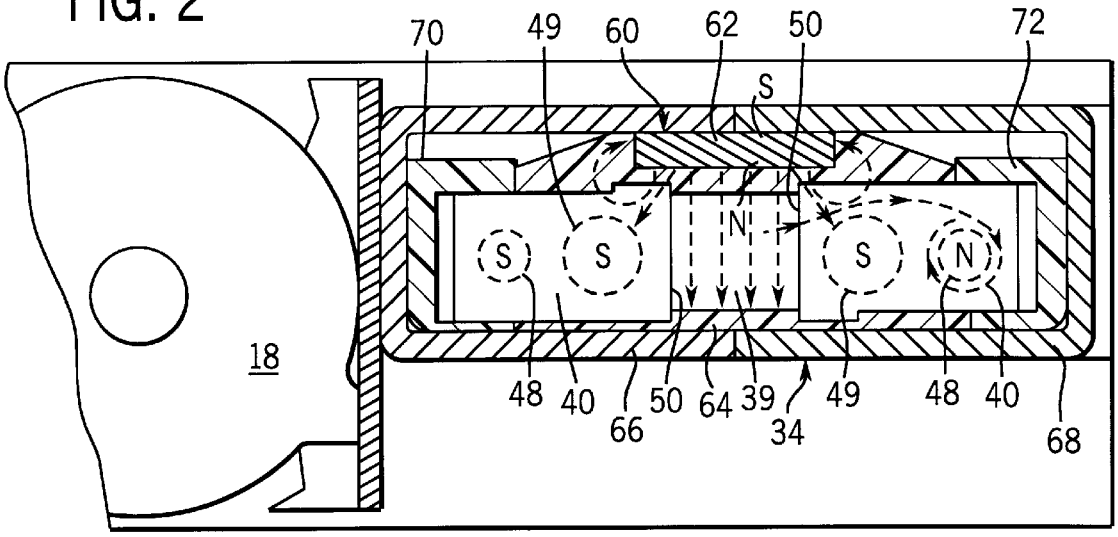
FIG. 2 is a cross-sectional view of the extinguishing chamber along line 2—2 in FIG. 1.

Because the contactor 10 switches direct current, a magnetic field is employed to move electric arcs into the arc extinguishing chamber 34. Referring to FIG. 2, that magnetic field is produced across center region 39 of arc extinguishing chamber 34 by a drive magnet assembly 60. This assembly comprises a permanent type arc drive magnet 62 located outside a plastic housing 64 of the arc extinguishing chamber 34 and extending along the full height of that chamber. In the illustrated embodiment of the present invention, the north pole of the arc drive magnet faces toward the splitter plates 40. The arc drive magnet 62 is magnetically coupled to a pair of iron, U-shaped members 66 and 68 that abut the outside surface of that magnet and extend around opposite sides of the arc extinguishing chamber 34. A pair of plastic brackets 70 and 72 hold the splitter plates 40 in notches of the plastic housing 64 and close that housing. The coupling of permanent magnet 62 with U-shaped members 66 and 68 establishes a magnetic field across the arc-extinguishing chamber 34 (vertically in FIG. 2), which directs electric arcs formed between the contact pads 30 and 32 toward the splitter plates 40, as will be described.

With reference to FIG. 1, when the contactor 10 opens, the armature 22 and the attached contact arm 28 move away from the stationary contacts 15 and 17 which causes the contact pads 30 and 32 to separate and move into the position shown. As the contact pads 30 and 32 separate, an arc 77 may form there between. The force produced by the interaction of the arc current with the magnetic field from the arc drive magnet 62 (FIG. 2) causes the arc 77 to move from contact pad 32 outward along the stationary contact 17 toward the outside stack 38 of splitter plates in arc extinguishing chamber 34. At the same time, the arc 77 moves off the other contact pad 30 onto the tip of the moveable contact arm 28.

The arc 77 propagates along the stationary contact 17 and onto the top splitter plate 40 in the outer stack 38. The arc then bridges the vertical gaps between adjacent splitter plates 40 in the outer stack. Eventually the arc 77 travels down the outer stack 38 to the point where the other end of the arc travels onto the top splitter plate 40*a* in the inner stack 36. When the arc 77 attaches to the top plate 40*a* in the inner stack 36, the arc in the other arc extinguishing chamber for stationary contact 15 is shorted out and fully extinguished because of the connection of that top plate 40*a* to the opposite power terminal 14 by wire braid 41.

To make the DC switching apparatus insensitive to current direction, two arc extinguishing chamber are employed. Only one arc extinguishing chamber is active for a given current direction due to the orientation of the arc drive magnet's magnetic field. For a given current direction, one arc 77, between one set of stationary and movable contacts pads 30 and 32, is driven into its adjacent arc extinguishing chamber while the another arc between the other set of contact pads is driven away from its arc extinguishing chamber. That other arc bridges between the moveable contact arm 28 and stationary contact 15. Copper braid 41, shown in FIG. 1, extinguishes the arc as soon as the arc makes contact with plate 40*a*. Without the arc "crowbaring" action by braid 41, the stationary contact 15 and moveable contact arm 28 would be damaged. The same functionality applies to the second braid 47 when the current direction is reversed.

However, arc 77 is not extinguished at that time and continues propagating further downward onto each subsequent splitter plate 40 in stacks 36 and 38. This action forms a separate sub-arc in the vertical gaps between adjacent splitter plates 40. Eventually the arc 77 spans a sufficient number of gaps between the splitter plates so as to build up significant arc voltage which extinguishes the arc.

When an arc is established between a pair of adjacent splitter plates 40, it experiences a Lorentz force due to the magnet structure 46. That force causes the arc to move from curved edge 50 of the splitter plate across legs 43 and 45 in a path illustrated by dotted lines in FIG. 2. As the arc propagates onto the legs of the splitter plate, the influence of the fringe magnetic field from arc drive magnet 62 on the arc motion is in a direction assisted by the radial magnetic field of the laminated magnet assembly 48. The interaction of the arc with this radial magnetic field causes the arc to be spun around the laminated magnet on the splitter plate surface. The arc can contact a splitter plate anywhere along the curved edge 50. Because the facing poles of the laminated magnet assemblies 48 in adjacent splitter plates 40 are of the same, both south poles in this embodiment, the arc spinning motion is continuous and stalling is prevented.

Figure 5:
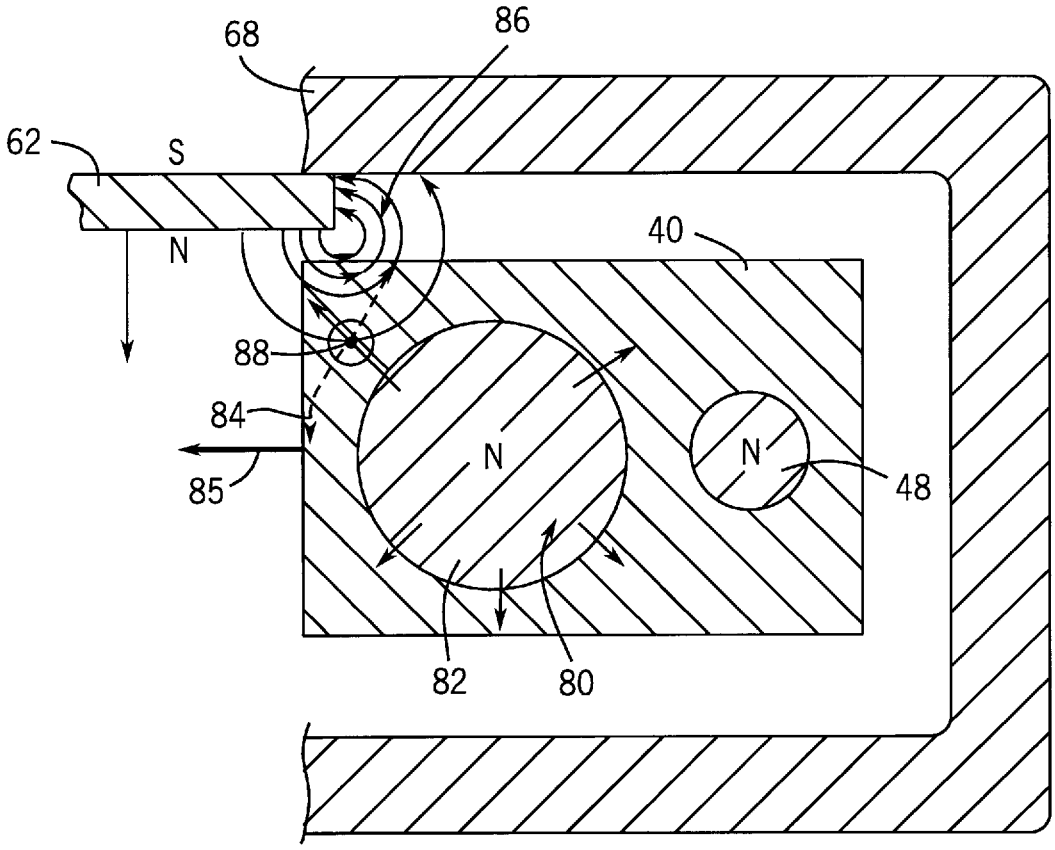
FIG. 5 is a cross sectional view of one side of the arc extinguishing chamber with an improperly constructed magnet assembly to show the benefits of the proper assembly.

If laminated magnet assembly 46 is replaced by a single permanent magnet body 80 as shown in FIG. 5, one magnetic pole of that magnet body 80 would be adjacent to one major surface of the splitter plate 40 and the opposite magnetic pole would be adjacent to the other major surface. Therefore in the exemplary structure illustrated in FIG. 5, the north magnetic pole 82 would appear at one of those surfaces. Arrow 85 depicts the direction of the arc current. This produces a Lorentz force which acts on the arc 88 in a direction depicted by arrow 84, i.e. counterclockwise around the magnetic body 80. However, the direction of the fringe magnetic field 86 from the arc drive magnet 62 interacts to drive the arc 88 toward the arc drive magnet, e.g. clockwise around magnetic body 80. These conflicting forces cause the arc motion to stall in a region between the arc drive magnet 62 and the magnetic body 80, thereby concentrating the arc energy in one spot resulting in melt through of the splitter plate 40. Therefore, the laminated magnet assembly 46 with like magnetic poles adjacent to surfaces of the splitter plate 40, as seen in FIG. 3, is critical to producing movement of the arc onto the splitter plates.

The function of the arc spin magnet 49 is to "capture" the moving arc and continuously rotate the arc about that magnet 49 until current interruption occurs. The arc spin magnet 49 produces a much stronger magnetic field than the laminated magnet assembly 48 because its relative length is longer than that of the individual magnets in the laminated structure. If the arc spin magnet was eliminated, the arc could escape the weaker radial magnetic field of the laminated magnet assembly 48 resulting in arc mobility truncation and splitter plate melt through due to a stalled arc.

The arc spin magnet 49 of each splitter plate in the preferred embodiment preferably is smaller in diameter than the laminated magnet assembly 48. Because the arc spin magnet 49 is a single magnetic body, its force is significantly greater than the laminated assembly and thus can be made smaller in diameter. In addition the smaller diameter provides a greater area on the surface of the plate legs 43 and 45 on which the arc can rotate. This reduces the possibility of the arc spinning off of the splitter plate edge. Nevertheless the present invention is not limited to a particular size relationship between the two magnets 48 and 49 of each splitter plate. Similarly the orientation of the poles of the magnet may be reversed from those illustrated in the drawings.

We claim:

1. An arc extinguishing mechanism for an electric current switching apparatus, the arc extinguishing mechanism comprising:

a plurality of splitter plates arranged adjacent one another with each splitter plate having a casing containing a magnet assembly, the casing being formed of a non-ferrous, electrically conductive material and having first and second exterior surfaces, the magnet assembly including a first magnet structure with a magnetic pole of a first polarity facing the first exterior surface and another magnetic pole of the first polarity facing the second exterior surface, the magnet assembly also including a second magnet structure with a magnetic pole of the first polarity facing the first exterior surface and another magnetic pole of a second polarity facing the second exterior surface, the magnet assembly produces a magnetic field around the casing which, when an arc is created within the electric current switching apparatus, causes the arc to move about one of the exterior surfaces of the casing.

2. The arc extinguishing mechanism as recited in claim 1 wherein the plurality of splitter plates are arranged with each one having at least one of the first and second exterior surfaces facing an exterior surface of an adjacent splitter plate with a gap there between.

3. The arc extinguishing mechanism as recited in claim 1 wherein the first magnet structure comprises a first permanent magnet having north and south magnet poles, a second permanent magnet having north and south magnet poles, and a body of magnetic material between the first and second permanent magnets with either both north poles or both south poles abutting the body.

4. The arc extinguishing mechanism as recited in claim 3 wherein the first magnet structure is cylindrical.

5. The arc extinguishing mechanism as recited in claim 1 wherein the first and second magnet structures are cylindrical.

6. The arc extinguishing mechanism as recited in claim 1 wherein the permanent magnet assembly further comprises a holder for retaining the first and second magnet structures thin the casing.

7. The arc extinguishing mechanism as recited in claim 6 wherein the holder is formed of non-magnetic material.

8. The arc extinguishing mechanism as recited in claim 6 wherein the casing has an oblong tubular shape.

9. An electric current switching apparatus comprising:

first and second power terminals;

a stationary contact electrically connected to the first power terminal;

a movable contact which selectively engages the stationary contact to complete an electrical connection between the first and second power terminals;

an actuator for moving the movable contact into and out of engagement with the stationary contact; and an arc extinguishing chamber having a plurality of splitter plates adjacent to the movable contact and the stationary contact and arranged to provide a plurality of gaps between adjacent splitter plates, each splitter plate comprises:

(a) a casing of a non-ferrous, electrically conductive material and having first and second exterior surfaces, (b) a first permanent magnet structure within the casing and having a magnetic pole of a first polarity facing the first exterior surface and another magnetic pole of the first polarity facing the second exterior surface, and (c) a second permanent magnet structure within the casing and having a magnetic pole of the first polarity facing the first exterior surface and another magnetic pole of a second polarity facing the second exterior surface, wherein the first and second permanent magnet structures produce a magnetic field around the casing which, when an arc is created within the electric current switching apparatus, causes the arc to move about one of the exterior surfaces of the casing.

10. The arc extinguishing mechanism as recited in claim 9 wherein the plurality of splitter plates are arranged with at least one of the first and second exterior surfaces facing an exterior surface of an adjacent splitter plate with a gap there between.

11. The arc extinguishing mechanism as recited in claim 9 wherein the first magnet structure comprises a first permanent magnet having north and south magnet poles, a second permanent magnet having north and south magnet poles, and a body of magnetic material between the first and second permanent magnets with either both north poles or both south poles abutting the body.

12. The arc extinguishing mechanism as recited in claim 11 wherein the first magnet structure is cylindrical.

13. The arc extinguishing mechanism as recited in claim 9 wherein the first and second magnet structures are cylindrical.

14. The arc extinguishing mechanism as recited in claim 9 wherein the permanent magnet assembly further comprises a holder for retaining the first and second magnet structures within the casing.

15. The arc extinguishing mechanism as recited in claim 14 wherein the holder is formed of non-magnetic material.

16. The arc extinguishing mechanism as recited in claim 9 wherein the casing has an oblong tubular shape.

17. The electric current switching apparatus as recited in claim 9 wherein one of the plurality of splitter plates is electrically connected to the second terminal.

18. The electric current switching apparatus as recited in claim 8 further comprising a drive magnet assembly adjacent to both the stationary contact and the movable contact for establishing a magnetic field that causes an electric arc to move into the arc extinguishing chamber.

* * * * *